US005184334A

United States Patent [19]

Vollert

[11] Patent Number: 5,184,334

[45] Date of Patent: Feb. 2, 1993

[54] SEALED CONTROL ARRANGEMENT FOR A TIMEPIECE

[75] Inventor: Alfred Vollert, La Chaux-de-Fonds, Switzerland

[73] Assignee: Fabrique Ebel SA, La Chaux-de-Fonds, Switzerland

[21] Appl. No.: 617,647

[22] Filed: Nov. 26, 1990

[30] Foreign Application Priority Data

Nov. 27, 1989 [FR] France ..... 89 15690

[51] Int. Cl.[5] ..... G04B 29/00

[52] U.S. Cl. ..... 368/319; 368/320

[58] Field of Search ..... 368/319-321, 368/287-291

[56] References Cited

U.S. PATENT DOCUMENTS

| | | | |
|---|---|---|---|
| 2,284,594 | 5/1942 | Schmitz | 368/290 |
| 3,418,800 | 12/1968 | Hashii | 368/319 |
| 4,313,187 | 1/1982 | Waki et al. | 368/321 |
| 4,451,719 | 5/1947 | Lauterberg | 368/321 |

FOREIGN PATENT DOCUMENTS

| | | | |
|---|---|---|---|
| 0149970 | 7/1985 | European Pat. Off. | 37/10 |
| 140469 | 11/1930 | Switzerland . | |
| 213466 | 3/1941 | Switzerland . | |
| 324258 | 10/1957 | Switzerland . | |
| 610467 | 8/1977 | Switzerland | 3/4 |
| 617310 | 5/1980 | Switzerland | 368/319 |
| 772940 | 4/1957 | United Kingdom | 368/319 |

*Primary Examiner*—Bernard Roskoski

*Attorney, Agent, or Firm*—Griffin, Butler, Whisenhunt & Kurtossy

[57] ABSTRACT

The sealed control arrangement for a timepiece is lodged in a case (20) and includes a crown (46) rotating around a tube. The crown includes an integrally formed head (10), central portion (23) and lateral skirt (12). The internal wall (11) of the skirt exhibits a cylindrical surface over its entire height. A packing (13) having the form of an annular bandage surrounding the tube exhibits an annular projection (16) on its internal portion corporating with an annular groove (15) formed in the tube. The external portion of said bandage is shaped in a manner such that whatever be the axial position of the crown (46), the lower edge (24) of the internal wall of the skirt is always in contact with said external portion of the bandage. The arrangement allows correction of data displayed by the timepiece while exhibiting excellent reliability in respect of the sealing which it assures.

8 Claims, 2 Drawing Sheets

SEALED CONTROL ARRANGEMENT FOR A TIMEPIECE

This invention concerns a sealed control arrangement for a timepiece lodged in a case including a crown rotating around a tube projecting from the case, said crown comprising a head integrally formed on the one hand with a central cylindrical portion fixed to a stem adapted to occupy at least two axial positions, one of which is a pushed-in neutral position and the other a drawn-out active position, and on the other hand with a lateral skirt concentric to said central portion and spaced therefrom towards the exterior in a manner such as to leave an annular housing between said central portion and the internal wall exhibited by the skirt, said internal wall exhibiting a cylindrical surface, the diameter of which is constant over its entire height, said annular housing being shaped in order to receive the tube and a packing compressed between said tube and said internal wall.

BACKGROUND OF THE INVENTION

A control arrangement for a timepiece, whether such be for the winding thereof or simply for time setting, frequently employs a crown adapted to take up at least two axial positions and also capable of being driven manually in rotation. If the interior of the timepiece must be sealed from the external environment which includes dust and water, special measures must be undertaken in order to assure sealing of such crown in whatever positions it may occupy, as well as during its rotation.

FIG. 1 shows a known solution to the problem, such construction having been long employed by the assignee of the present application. In this drawing, a tube or pendant 4 is driven into a caseband 5. The crown cooperating with this tube includes a head 1 integrally formed with a central cylindrical portion 9 intended to receive a stem (not shown) in the threaded hole 7 and with a skirt 8. The interior wall of such skirt includes a first annular housing 2 of diameter slightly greater than the outer diameter of the tube and a second annular housing 3 of much greater diameter intended to receive a packing 40. The lower part of the second housing 3 is blocked by a ring 6 which may be set or driven and which has as function to maintain the packing 40 in place when the crown is axially displaced along the tube.

The construction of FIG. 1 shows at least two important disadvantages. The first difficulty in this construction is the necessity of having to change the entire crown during repairs which would normally necessitate only changing the packing since, in view of the presence of ring 6, the replacement of the packing alone is almost impossible. If such crown is of gold as is often the case, it will be understood that to discard it constitutes a substantial loss. The second difficulty exhibited by the construction as shown in FIG. 1 resides in the relative complexity for the manufacture of the crown and of the internal wall of its skirt which shows two different diameters 2 and 3, this necessitating calling on specialized manufacturers.

Attempts have already been made to overcome the difficulties cited hereinabove. Patent document CH-A-610 467 shows in effect a figure where the skirt of the crown exhibits an internal wall the diameter of which is constant over its entire height, this enabling simplification of the manufacture of the crown, and where a packing is placed in a housing provided in the tube, this enabling a relatively easy changing of said packing. However, the construction in this document exhibits a difficulty due to the fact that the skirt may become soiled and thus cause premature wear to the packing. Effectively, in view of the interstice separating the skirt from the tube, undesirable matter (dust, dirt, liquids) may soil the entire portion of the skirt located below the packing so that when the crown returns to its rest position, the seal comes into contact with such undesirable matter deposited on the skirt. Since such matters are often abrasive, the packing is damaged in scraping the skirt and quite rapidly loses its prime function which is to assure sealing of the crown.

SUMMARY OF THE INVENTION

To overcome this difficulty, this invention proposes a sealed control arrangement responding to the generic definition given at the beginning of this description and is characterized by the fact that the packing exhibits the form of an annular bandage, the internal portion of the bandage exhibiting at least one annular projection intended to penetrate into an annular groove exhibited by the tube, and the external portion of the bandage being shaped in a manner such that, whatever be the axial position of the stem, the lower edge exhibited by the internal wall of the skirt is always in contact with said external portion of the bandage.

The invention will be understood now with the help of the description to follow given by way of example and illustrated by means of the drawings.

DESCRIPTION OF THE PREFERRED EMBODIMENTS

Figure 2:
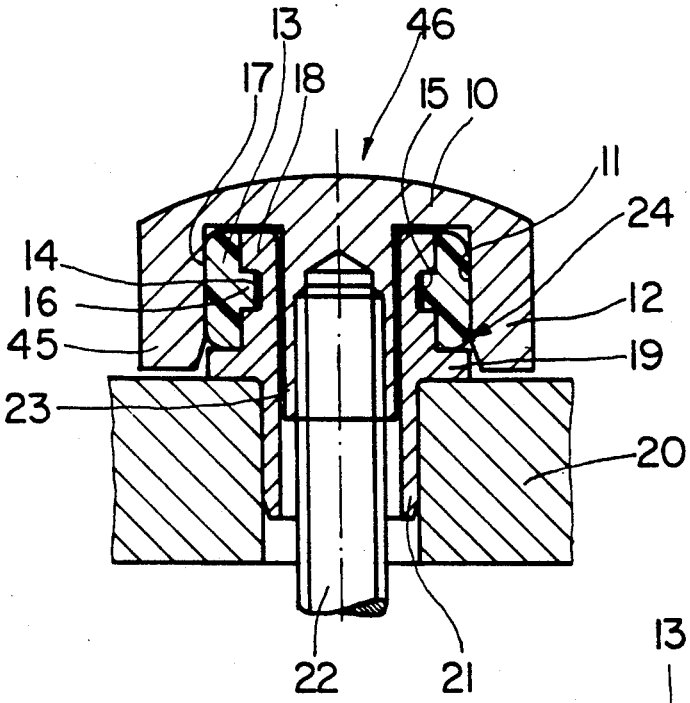
FIG. 2 is a cross-section of a control arrangement of a timepiece according to the invention shown in a first pushed-in rest position.
Figure 3:
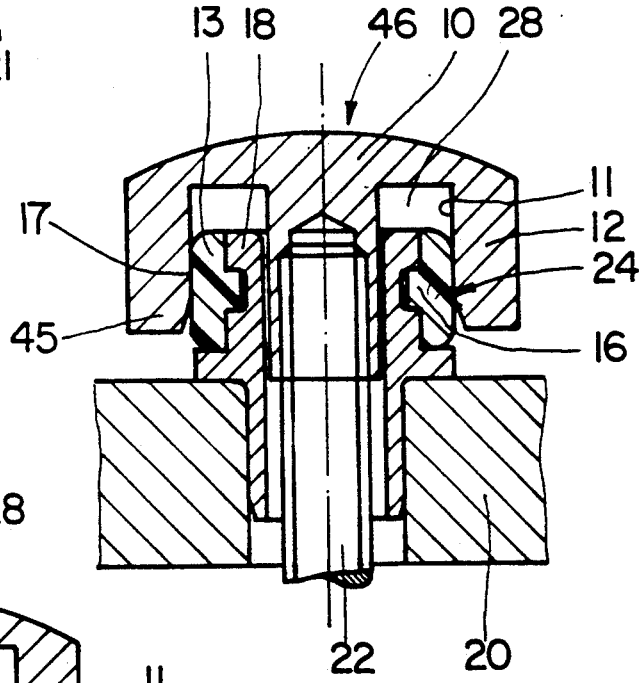
FIG. 3 is a cross-section similar to that shown on FIG. 2 in which the arrangement is in a second drawn-out working position.
Figure 4:
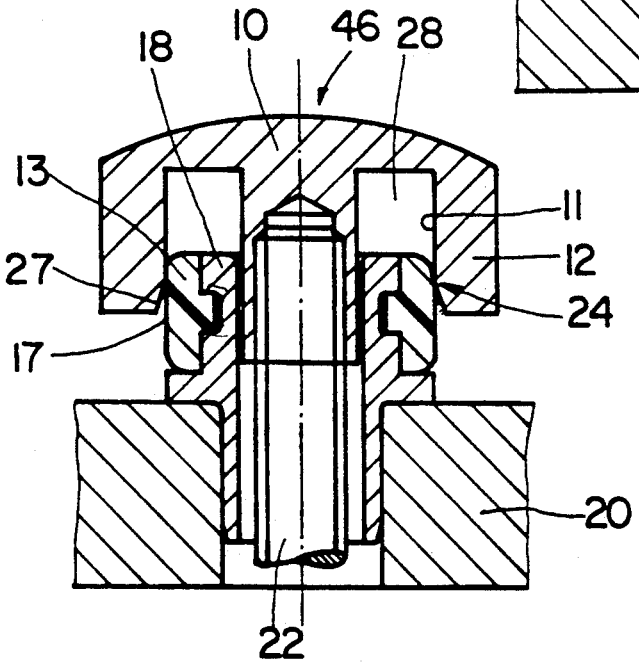
FIG. 4 is a cross-section similar to that shown on FIG. 2 in which the arrangement is found in a third drawn-out working position.

As is seen on FIGS. 2, 3 and 4, the sealed control arrangement of the timepiece is housed in a case 20 which may be the caseband of this watch case. The arrangement includes a crown 46 comprising head 10, integrally formed on the one hand with a central cylindrical portion 23 attached to a stem 22 and on the other hand with a lateral skirt 12 which is concentric to said central portion 23 and spaced therefrom towards the exterior in a manner such as to leave an annular housing 28 between said central portion 23 and the internal wall 11 exhibited by skirt 12. The crown 46 is adapted to turn around a tube 21 projecting from the case 20 and driven into this latter. The internal wall 11 of the skirt 12 shows a cylindrical surface the diameter of which is constant over the entire height of said wall. The annular housing 28 is arranged in order to accommodate tube 21 and a packing 13 compressed between tube 21 and wall 11.

As is seen on FIGS. 2 to 4 and according to an essential characteristic of the invention, packing 13 exhibits the form of an annular bandage, the internal portion of such bandage exhibiting at least one annular projection 16 which penetrates into an annular groove 15 exhibited by tube 21. Thus, it is understood that packing 13 is maintained in place, whatever may be the axial movements of the crown, by the cooperation of such projection and groove. A no less essential characteristic of the invention consists in shaping the external portion 17 of the bandage 13 in a manner such that, whatever be the axial position of stem 22, the lower edge 24 exhibited by skirt 12 is always in contact with said external portion of the bandage.

These characteristics are readily visible in the three axial positions which the crown may assume, such positions being respectively shown on FIGS. 2, 3 and 4. FIG. 2 is the neutral, pushed-in position, that for which no display correction is possible. Should this concern a mechanical timepiece, such position could be employed for winding. Here it is seen that the lower edge 24 of the skirt is in contact with the external portion 17 of the bandage which is found at the bottom thereof. FIG. 3 is the first drawn-out position of the crown, that for which it is possible to correct the time of day of the timepiece (or the date according to the calibre and in such case the crown may be put into a second drawn -out position). FIG. 3 shows that in this position the lower edge 24 of the skirt is in contact with the external portion 17 of the bandage, which is found in the middle thereof. FIG. 4 is the second withdrawn position of the crown, that for which it is possible for instance to correct the time of day of the timepiece, such timepiece also including a date display. FIG. 4 shows that, in this position, the lower edge 24 of the skirt is in contact with the external portion 17 of the bandage which is located at the top of the latter.

Thus, from the preceding explanation, the lower edge 24 of the skirt is continually in contact with packing 13, whatever be the axial position of the crown, and from this fact it is evident that the internal wall 11 of the skirt remains clean and may not be soiled by agents outside the timepiece, this conferring on the packing a clearly increased life duration.

As appears on the drawing, a preferred embodiment consists in giving the outer portion 17 of the bandage 13 the form of a cylinder, the height of which is substantially equal to the height of the internal cylindrical wall 11 of skirt 12. In this case, one also prefers to arrange a clearance 14 between the projection 16 exhibited by the packing and the bottom of the annular groove 15 provided on tube 21, this clearance giving the seal more flexibility and in a manner of speaking, permitting "breathing" thereof.

In fact, the clearance 14 assures two more marked pressure zones between the packing and the internal wall of the skirt, namely a first pressure zone situated towards the top of the tube and a second pressure zone situated towards the bottom of the tube, the first zone having as prime purpose the actual sealing and the second zone having as prime purpose the maintenance of the skirt free from dirt.

Figure 1:
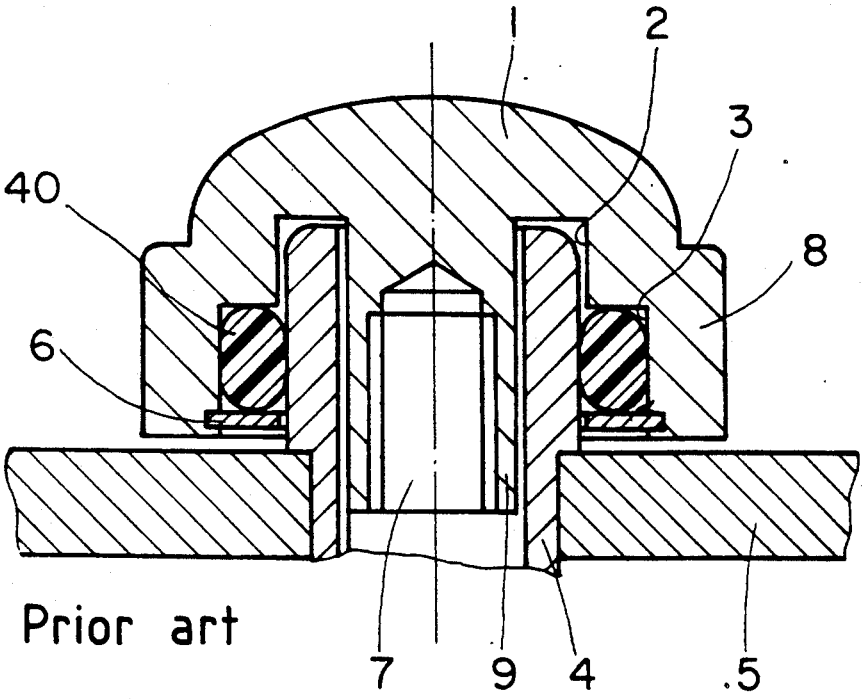
Prior art Fig. 1
FIG. 1 is a cross-section of a control arrangement according to the prior art discussed hereinabove.
Figure 5:
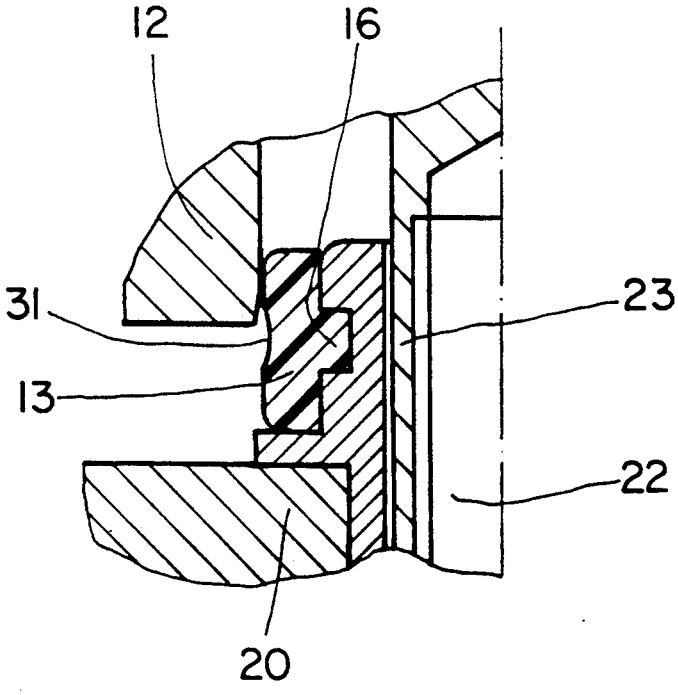
FIG. 5 is an enlargement of a portion of figure 4 showing a packing formed in a different manner from that exhibited on FIGS. 2 to 4.

The clearance as has been mentioned in the preceding paragraph could be eliminated should one adopt the special embodiment shown on FIG. 5. This figure, which is an enlargement of a portion of FIG. 4, shows that the bandage 13, (if it continues to exhibit an external portion having the general form of a cylinder, the height of which is substantially equal to the height of the cylindrical wall of the skirt) exhibits a groove 31 of small depth located substantially facing the annular projection 16. Here one thus finds also two pressure zones as mentioned hereinabove.

Whether one chooses one or the other solution (clearance 14 or groove 31), it will be understood that between the two pressure zones there exists a relaxation zone which contributes to preventing the packing from adhering too strongly against the internal wall of the skirt.

FIGS. 2 to 4 further show that a chamfer 27 is provided in a prolongation 45 of skirt 12, such prolongation being located beyond the lower edge 24 of the cylindrical wall 11 of the skirt. This chamfer has evidently as purpose to avoid damaging the packing 13 by an edge which could be cutting.

Tube 21 includes a flange 19 which has as purpose the exact positioning of the tube relative to the case 20. In the drawings, it is seen that the diameter of the flange is slightly less than the diameter of the internal cylindrical wall 11 of skirt 12 and that the bandage 13 extends from the upper face of the flange 19 to the upper edge 18 of tube 21. This arrangement permits a better seating of the bandage on the tube.

In the construction which has just been described, it is noted that crown 46 is easy to manufacture since it exhibits on the interior only a smooth cylindrical wall. The difficulties of manufacture are here carried over to tube 21 and such difficulties do not really exist since here it concerns a simple external profile turning regularly encountered in machining practice.

According to FIGS. 2 to 5, it is seen that the annular projection 16 of packing 13 is located at the middle of this packing so that said packing exhibits a symmetry relative to a plane perpendicular to the plane of the figures and passing through the middle of the projection. This arrangement is advantageous since it enables assembly of the packing onto the tube without having to be concerned with the sense of the assembly.

FIGS. 3, 4 and 5 show that the packing 13 is uncovered when the arrangement is in the withdrawn position, thus rendering the packing visible to the wearer of the timepiece. This particularity, which has always been considered as a difficulty, is here an advantage in order to indicate to the user that the crown is in an abnormal position where corrections of the time of day or date could be brought about in an untimely manner and thus incite the user to push the crown back into its neutral position. Such abnormal position could be rendered still more visible by colouring the packing by a live colour (red or yellow for instance).

What I claim is:

1. A sealed control arrangement for a timepiece, said sealed control arrangement being lodged in a case and including a crown rotatable about a tube projecting from said case, a stem extending into said tube, said stem being movable between at least two axial positions including a neutral pushed-in position and an active drawn-out position, said crown comprising a head integrally formed with a central cylindrical portion that is fastened to said stem, said head being integrally formed with a lateral skirt concentric with said central cylindrical portion and outwardly spaced therefrom so as to form an annular housing between said central cylindrical portion and an internal wall of said skirt, said internal wall exhibiting a cylindrical wall surface having a constant diameter over its entire height, said annular housing being shaped to receive said tube; a packing in the form of an annular bandage compressed between said tube and said internal wall, said packing having an external portion shaped such that a lower edge of said internal wall of said skirt is always in contact with said external portion of said packing regardless of the axial position of said stem, said tube having an annular groove and said packing having an annular projection on an internal portion thereof which penetrates into said annular groove to prevent movement of said packing relative to said tube as said stem is moved.

2. A control arrangement as set forth in claim 1 wherein a chamfer is formed in a prolongation of said skirt said chamfer being situated beyond said lower edge of said internal cylindrical wall surface.

3. A control arrangement as set forth in claim 1 wherein said external portion of said packing exhibits the form of a cylinder having a height which is substantially equal to the height of the internal cylindrical wall surface of said skirt.

4. A control arrangement as set forth in claim 1 wherein a clearance is provided between said projection on said internal portion of said packing and the bottom of said annular groove of said tube.

5. A control arrangement a set forth in claim 1 wherein said external portion of said packing is generally in the form of a cylinder having a height which is substantially equal to the height of said internal cylindrical wall surface of said skirt, an annular groove of small depth being provided in said cylinder substantially opposite said annular projection on said internal portion of said packing.

6. A control arrangement as set forth in claim 1 wherein said tube includes a flange for the positioning thereof relative to said case, said flange having a diameter slightly less than the diameter of said internal cylindrical wall surface of said skirt and wherein said packing extends from an upper face exhibited by said flange to an upper edge exhibited by said tube.

7. A control arrangement as set forth in claim 1 wherein said packing is symmetric in respect of a plane passing through the middle of said annular projection.

8. A control arrangement as set forth in claim 1 wherein said packing is visible whenever said stem is in said active drawn-out position.

* * * * *